US005245965A

United States Patent [19]

Andersson

[11] Patent Number: 5,245,965

[45] Date of Patent: Sep. 21, 1993

[54] CAPACITOR DISCHARGE ENGINE IGNITION SYSTEM WITH AUTOMATIC SPEED LIMITING

[75] Inventor: Martin N. Andersson, Caro, Mich.

[73] Assignee: Walbro Corporation, Cass City, Mich.

[21] Appl. No.: 935,189

[22] Filed: Aug. 26, 1992

[51] Int. Cl.[5] ..... F02P 11/02; F02P 3/08

[52] U.S. Cl. ..... 123/335

[58] Field of Search ..... 123/198 D, 335, 418, 123/599, 602

[56] References Cited

U.S. PATENT DOCUMENTS

| | | | |
|---|---|---|---|
| 3,703,889 | 11/1972 | Bodig et al. | 123/602 |
| 3,998,198 | 12/1976 | Jereb | 123/599 |
| 4,252,095 | 2/1981 | Jaulmes | 123/335 X |
| 4,324,215 | 4/1982 | Sieja | 123/335 |
| 4,344,395 | 8/1982 | Kondo et al. | 123/335 |
| 4,436,076 | 3/1984 | Piteo | 123/602 |
| 4,641,618 | 2/1987 | Dogadko et al. | 123/335 |
| 5,138,995 | 8/1992 | Erhard | 123/335 |

FOREIGN PATENT DOCUMENTS

| | | | |
|---|---|---|---|
| 3424388 | 1/1986 | Fed. Rep. of Germany | 123/335 |
| 50266 | 5/1981 | Japan | 123/335 |
| 2043166 | 10/1980 | United Kingdom | 123/335 |

*Primary Examiner*—Tony M. Argenbright

*Attorney, Agent, or Firm*—Barnes, Kisselle, Raisch, Choate, Whittemore & Hulbert

[57] ABSTRACT

A capacitor discharge engine ignition system that includes a charge coil responsive to a flywheel magnet for charging an ignition capacitor, and a trigger coil responsive to the flywheel magnet for triggering an SCR rapidly to discharge the capacitor through the primary of the ignition coil. Circuitry for automatically electronically limiting overspeed operation of the engine includes a capacitor connected to the trigger coil, and a voltage divider connected between the capacitor and the gate of the SCR. This capacitor is charged upon occurrence of each trigger signal, and during normal operation has sufficient time to discharge through the voltage divider before generation of the charge signal. However, when the engine is operating at excessive speed, there is sufficient charge on the trigger capacitor to gate operation of the SCR, short circuiting the ignition charge capacitor and preventing operation of the ignition.

5 Claims, 1 Drawing Sheet

CAPACITOR DISCHARGE ENGINE IGNITION SYSTEM WITH AUTOMATIC SPEED LIMITING

The present invention is directed to capacitor discharge engine ignition systems, and more particularly to automatic limiting of engine speed by limiting or inhibiting engine ignition.

It is important in many two-stroke and four-stroke small engine applications, such as chain saw and brush trimmer applications, that engine overspeed be inhibited in situations where the load is suddenly removed and the engine is operating at wide-open throttle. In saw applications where the blade is of steel or composite composition, for example, there can be a danger of blade fracture at high speed if engine overspeed operation is not limited. There can also be a danger of internal damage to the engine itself.

It is heretofore been proposed in small engine applications of the subject type that a ball-speed governor be coupled to the engine carburetor for limiting excess engine speed. As vibrations of the engine increase with speed, inertia of the ball overcomes the force of a positioning spring. As the governor ball moves off of its seat, extra fuel flows from the carburetor into the engine, temporarily flooding and slowing the engine. However, a ball-speed governor can be jammed or otherwise subject to tampering in an effort to increase engine speed and obtain faster operation of the engine. There is also substantial additional cost associated with the governor.

It is therefore a general object of the present invention to provide a capacitor discharge engine ignition system that is particularly well suited and adapted for operation in conjunction with either two-stroke or four-stroke small engines of the character described above, and that includes facility for automatically preventing overspeed operation of the engine. A more specific object of the invention is to provide an ignition system with overspeed feature of the character described that is not readily subject to tampering by an engine operator, that can be readily implemented at limited increase in manufacturing cost, and that is reliable over an extended operating lifetime.

Figure 1:
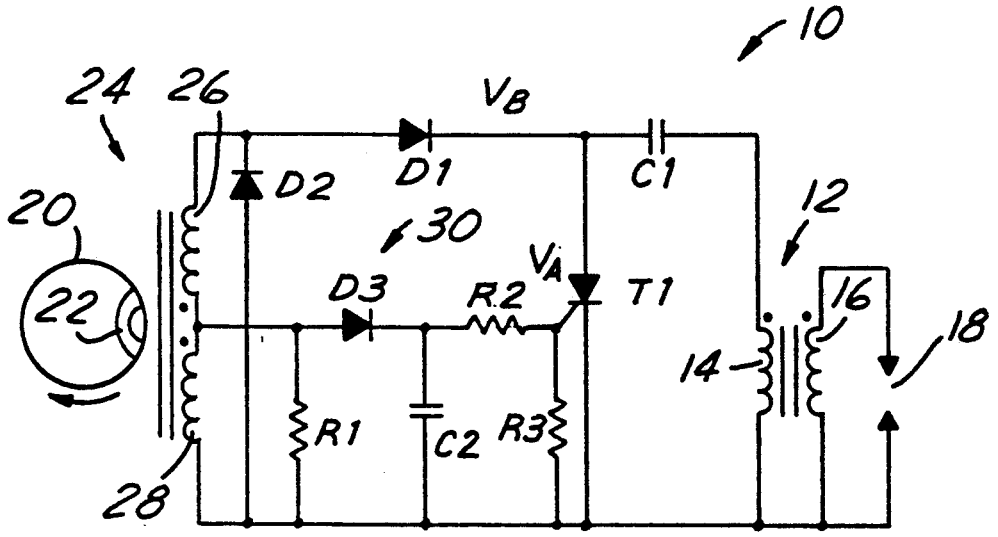
Figure 2:
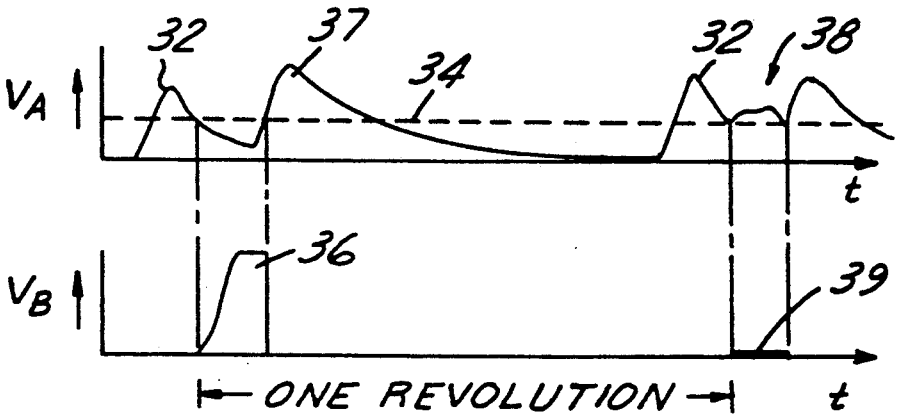
Figure 3:
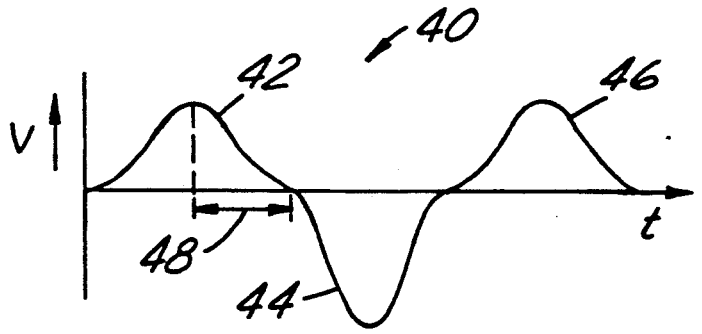

The invention, together with additional objects, features and advantages thereof, will be best understood from the following description, the appended claims and the accompanying drawings in which:

FIG. 1 is an electrical schematic diagram of a capacitor discharge engine ignition system in accordance with a presently preferred embodiment of the invention; and FIGS. 2 and 3 are signal timing diagrams useful in explaining operation of the embodiment of the invention illustrated in FIG. 1.

FIG. 1 illustrates a capacitor discharge engine ignition system 10 in accordance with a presently preferred embodiment of the invention as comprising an ignition coil 12 having a primary winding 14 and a secondary winding 16 coupled to a spark plug 18 for initiating ignition in an engine. A flywheel 20 is suitably coupled to the engine crankshaft, and carries at least one magnet 22 that rotates in synchronism with engine operation. A coil assembly 24 is disposed for coupling with magnet 22 as flywheel 20 rotates for generating signals (FIG. 3) in the coil assembly. Coil assembly 24 includes a charge coil section 26 that is connected through a diode D1 and a capacitor C1 to primary winding 14 of ignition coil 12. A trigger coil section of assembly 24,28 is connected at one end to charge coil 26, and at its other end to the end of primary winding 14 remote from capacitor C1. Thus, a closed current path is formed from charge coil 26 through diode D1, capacitor C1, primary winding 14 and trigger coil 28. A diode D2 is connected across coils 26,28 to provide a reverse current path and reduce ringing in the charge and trigger coils. An electronic switch, preferably in the form of an SCR T1, has primary currentconducting anode and cathode electrodes respectively connected to the junction of diode D1 and capacitor C1, and to the junction of primary winding 14 and trigger coil 28. SCR T1 also has a control or gate electrode that is operatively connected to the junction of coils 26,28.

To the extent thus far described, ignition system 10 is of generally conventional construction and operation. Upon each rotation of magnet 22 past coils 26,28 there is generated in coils 26,28 a signal as illustrated in FIG. 3, in which signal voltage V is plotted versus time t. Polarity of coils 26,28 (illustrated in FIG. 3) and polarization of diodes D1,D2 are such that the first peak 42 (FIG. 3) is applied to the gate of SCR T1 to trigger the SCR. The second peak 44 is applied through diode D1 and winding 14 to charge capacitor C1. During this time, SCR T1 must be non-conducting for normal operation. Upon continued rotation, the third peak 46 of signal 40 (FIG. 3) is again of polarity to trigger SCR T1 rapidly to discharge capacitor C1 through primary coil 14, thereby inducing a high voltage signal in secondary winding 16 and initiating engine ignition at spark plug 18.

In accordance with the present invention, circuitry generally indicated by the reference numeral 30 is operatively connected between trigger coil 28 and the gate of SCR T1 for automatically limiting or inhibiting operation of the ignition system in the event of engine overspeed. Circuitry 30 includes a resistor R1 connected across coil 28. A diode D3 has its anode connected to the junction of coils 26,28. A capacitor C2 is connected between the cathode of diode D3 and the junction of coil 28 and winding 14. A pair of resistors R2,R3 are connected in series across capacitor C2, and the gate of SCR T1 is connected to the junction of resistors R2,R3. Signal sections or peaks 42,46 (FIG. 3) charge capacitor C2 through diode D3, which prevents discharge of capacitor C2 through either coil 28 or resistor R1. Between such trigger signals, the charge on capacitor C2 discharges through resistors R2,R3. As long as engine speed remains below a threshold determined by the component values of capacitor C2 and resistors R2,R3, there is sufficient time after trigger signal 42 to allow capacitor C2 to discharge through resistors R2,R3 before generation of a signal 44 in coil 26 to charge capacitor C1. However, when engine speed exceeds this threshold, there remains sufficient charge on the capacitor C2 to gate operation of SCR T1 during at least the initial portion of charge signal 44 in coil 26, so that SCR T1 effectively short circuits such charge signal and prevents charging of capacitor C1.

Component values for resistors R2,R3 and capacitor C2 are determined by the desired speed limiting threshold, and by the mechanical design of flywheel 20 and magnet 22 that generate signal 40 (FIG. 3). Specifically, the discharge time of capacitor C2 through resistors R2,R3 must be less than the time 48 in FIG. 3 up to the desired speed threshold, and approximately equal to time 48 at the desired speed threshold. By way of example only, assume a flywheel diameter of 90 mm and magnet design to yield a signal 40 (FIG. 3) with 36° between peaks 42,44,46, on SCR gate voltage of 0.6 volts and a peak voltage of three volts on capacitor C2. To obtain a speed limiting threshold of 9,000 rpm, in one preferred but exemplary embodiment of the invention with these parameters, resistor R2 was chosen to be 470 ohms, resistor R2 392 ohms, and capacitor 12 0.47 microfarads. Winding characteristics of coils 12,24 and values of the remaining components in system 10 (FIG. 1) are chosen in the usual manner to obtain desired characteristics during normal operation.

Operation is illustrated in FIG. 2, which is a timing diagram that illustrates voltage $V_A$ at the junction of resistors R2,R3 on a common time base with the voltage $V_B$ across capacitor C1. During normal operation, the initial signal 32 applied by trigger coil 28 to capacitor C2 will have sufficient time to discharge below the SCR trigger threshold 34 before application of the charge signal 36 to capacitor C1. The voltage $V_B$ on capacitor C1 will thus increase, as shown at 36, to its maximum level, and rapidly discharge through SCR T1 and primary winding 14 when the voltage on capacitor C2 caused by the subsequent trigger signal 37 again reaches SCR trigger threshold 34. On the other hand, when engine speed is excessive, the voltage 32 on capacitor 28 will not have an opportunity to discharge below threshold 34 before occurrence of the next charge signal 39. Thus, as shown at 38, SCR T1 is gated to a conductive condition, effectively to short circuit charge signal 39 and prevent charging of capacitor C1. Resistor R1 (e.g., 75 ohms) places a load on trigger coil 28 to reduce amplitude sensitivity of pulses 42,46 (FIG. 3) to air gap setting between flywheel magnet 22 and the core of coil assembly 24.

A feature of the preferred embodiment of the invention illustrated in FIG. 1 is that there is a transition band of frequencies during which ignition operation is limited, but not completely inhibited, by enabling engine ignition on alternate power strokes. In one implementation of the present invention, for example, the engine operates normally below about 9,000 rpm, misfires alternately between about 9,000 and completely inhibits engine operation at speeds higher than about 9,300 rpm. Thus there is in effect a limited overspeed facility between the upper threshold of 9,300 rpm and the lower threshold of 9,000 rpm, as distinguished from the complete inhibiting of engine operation above the higher threshold. System operation returns automatically to normal operation as soon as engine speed has fallen below the lower speed threshold without requiring operation of a manual reset switch or the like.

There has thus been provided in accordance with the invention a capacitor discharge engine ignition system that fully satisfies all of the objects and aims previously set forth. Circuit components may be related to provide overspeed limiting at any desired speed. The invention may be implemented at low cost in either two-stroke or four-stroke engines, and in either single-cylinder or multiple-cylinder applications. The invention may be implemented in ignitions with separate charge and trigger coils, in which the charge and trigger coil sections form part of a single coil on a single core by or in which the trigger coil is formed as part of the charge coil or the primary winding of the ignition coil.

I claim:

1. A capacitor discharge engine ignition system that includes:

ignition coil means having a primary winding and a secondary winding for coupling to engine ignition means, an ignition charge storage capacitor coupled to said primary winding, electronic switch means having primary current conducting electrodes in circuit with said ignition charge storage capacitor and said primary winding, and a control electrode responsive to trigger signals for operatively connecting said ignition charge storage capacitor to discharge through said primary winding, charge/trigger coil means for generating periodic signals in synchronism with operation of the engine, including charge coil means for generating signal energy to charge said ignition charge storage capacitor and trigger coil means for generating said trigger signal, and speed limiting means operatively coupled to said trigger coil means and to said control electrode for maintaining said trigger signal at said control electrode, and thereby preventing charging of said ignition charge storage capacitor, when frequency of said trigger signals is above a first threshold, said speed limiting means being constructed and arranged to limit charging of said ignition charge storage capacitor when frequency of said trigger signals is between said first threshold and a second threshold less than said first threshold.

2. The system set forth in claim 1 wherein said speed limiting means comprises second charge storage means coupled to said trigger coil means, voltage discharge means coupled to said second storage means, and means coupling said control electrode to said discharge means.

3. The system set forth in claim 2 wherein said charge/trigger coil means is constructed and arranged to generate one of said charge signals and a pair of said trigger signals leading and trailing said charge signal upon each cycle of operation of the engine.

4. An engine ignition system that includes:

ignition coil means having a primary winding and a secondary winding for coupling to engine ignition means, electronic switch means having primary current conducting electrodes in circuit with said primary winding, and a control electrode responsive to trigger signals for operatively switching current through said primary winding, trigger coil means for generating said trigger signal in synchronism with operation of the engine, and speed limiting means operatively coupled to said trigger coil means and to said control electrode for maintaining said trigger signal at said control electrode, and thereby preventing switching of said switch means, when frequency of said trigger signals is above a first threshold;

said speed limiting means being constructed for intermittently maintaining said trigger signal at said control electrode, and thereby intermittently preventing switching of said switch means, when frequency of said trigger signals is between said first threshold and a second threshold less than said first threshold.

5. The system set forth in claim 4 wherein said speed limiting means comprises charge storage means coupled to said trigger coil means, voltage discharge means coupled to said storage means, and means coupling said control electrode to said discharge means.

* * * * *